US008783892B2

(12) United States Patent
Liao

(10) Patent No.: US 8,783,892 B2
(45) Date of Patent: Jul. 22, 2014

(54) HAT WITH SOLAR SYSTEM

(75) Inventor: Sung-Yie Liao, Heping Shiang (TW)

(73) Assignee: Chuan Cheng Hat Co., Ltd., Taichung (TW)

( * ) Notice: Subject to any disclaimer, the term of this patent is extended or adjusted under 35 U.S.C. 154(b) by 365 days.

(21) Appl. No.: 13/414,787

(22) Filed: Mar. 8, 2012

(65) Prior Publication Data

US 2013/0033852 A1 Feb. 7, 2013

Related U.S. Application Data

(63) Continuation-in-part of application No. 12/252,568, filed on Oct. 16, 2008, now abandoned.

(51) Int. Cl.
*F21V 21/084* (2006.01)
*A42B 1/24* (2006.01)
*A42B 3/04* (2006.01)

(52) U.S. Cl.
CPC ..... *A42B 1/244* (2013.01); *A42B 3/0433* (2013.01); *A42B 1/24* (2013.01)
USPC ..... 362/105; 362/106

(58) Field of Classification Search
CPC ..... A42B 3/0433–3/0453; A42B 1/24; A42B 1/242
USPC ..... 362/105–106
See application file for complete search history.

(56) References Cited

U.S. PATENT DOCUMENTS

| | | | | |
|---|---|---|---|---|
| 5,845,987 | A | 12/1998 | Painter | 362/206 |
| 6,239,555 | B1 | 5/2001 | Rachwal | 315/200 R |
| 7,234,831 | B1 | 6/2007 | Hanley | 362/106 |
| 7,427,149 | B2 * | 9/2008 | Sohn | 362/374 |
| 7,524,079 | B2 | 4/2009 | Greenhoe | 362/183 |
| 8,002,437 | B2 * | 8/2011 | Sohn | 362/249.09 |
| 8,550,651 | B2 * | 10/2013 | Waters | 362/106 |
| 2003/0117104 | A1 | 6/2003 | Liao | 320/107 |
| 2005/0219837 | A1 | 10/2005 | Brown | 362/105 |
| 2006/0157569 | A1 * | 7/2006 | Becker | 235/462.42 |
| 2008/0130272 | A1 | 6/2008 | Waters | 362/106 |
| 2009/0147505 | A1 | 6/2009 | Robinett | 362/183 |
| 2009/0180278 | A1 | 7/2009 | Cheng et al. | 362/106 |
| 2010/0013428 | A1 | 1/2010 | Shin | 320/101 |
| 2011/0210685 | A1 * | 9/2011 | Liao | 315/313 |

* cited by examiner

*Primary Examiner* — David J Makiya

(57) ABSTRACT

A hat with a solar system comprises: a body, a power supply device, a lighting device, and a solar panel, wherein the power supply device is disposed on the body and has a control unit and a battery, the control unit has a charging circuit and at least one external charging connector that is electrically connected to an electronic device, the battery is able to charge the electronic device; the lighting device has a switch and at least one LED lighter and is electrically connected to the battery of the power supply device and turns on or shuts down the LED lighter; and the solar panel is electrically connected to the battery and transforms absorbed light into electric power, which is stored in the battery. Therefore, the present invention continuously provides power, lighting and safety reminder while the present invention is being applied in an outdoors.

12 Claims, 11 Drawing Sheets

HAT WITH SOLAR SYSTEM

CROSS REFERENCE

The present application is a continuation-in-part of U.S. patent application Ser. No. 12/252,568 filed on Oct. 16, 2008 now abandoned.

BACKGROUND OF THE INVENTION

1. Field of the Invention

The present invention generally relates to a hat, more particularly to a hat with a solar system.

2. Description of the Prior Art

With the population of outdoor sports and free time activities, such products may be advanced as well in order to meet the requirements of modern people. Electric power is a must to outdoor sports and free time, and the present power supply is generally a generator or the battery of a vehicle. Due to the reasons of a heavy weight, a huge volume, difficulty to carry, and burning fuel of the generator, that is to say, generator is not meeting the requirements of environment protection. The battery of the car has some problems same as the generator's, such as heavy weight, difficulty to carry, etc. Further, in the case of electric power being out, to find another external power source will be another serious problem.

With reference to FIG. 11, which is a portable battery box 100 developed by people skilled in the art. As a matter of fact, the battery box 100 is not convenient to be carried out, since the battery box 100 charging a charged battery set 120 through an input end 110 is only by a regular charger. If the battery box 100 is carried to a site without any regular charger or power supply, the electric power of the batter box 100 being out will be happening sooner or later; another case of forgetting charging the battery box 100 before going outdoors, the convenience and persistence are very limited.

Therefore, how to figure out the disadvantages of the prior arts is an important issue to the skilled people in the related field.

SUMMARY OF THE INVENTION

The disadvantages of prior arts to be solved are described after. An outdoor power supply is mainly a generator or the battery of a vehicle, but either of them is with the problems of a heavy weight, a huge volume, difficulty to carry, etc. A prior portable battery box is not convenient to be carried out since it can only be charged by a regular charger or a power supply. If the battery box is carried to a site without any regular charger or power supply, the electric power of the batter box being out will be happening sooner or later, the convenience and persistence are very limited.

The characters of the present invention to figure out the disadvantages of the prior art are described as follows. The present invention provides a hat with a solar system comprises: a body, a power supply device, a lighting device, and a solar panel, wherein the body has an accommodation bag; the power supply device is disposed in the accommodation bag of the body and has a control unit and a battery, the control unit has a charging circuit and at least one external charging connector that is electrically connected to an electronic device, the battery is able to charge the electronic device; the lighting device has a switch and at least one LED lighter, the lighting device is electrically connected to the battery of the power supply device and turns on or shuts down the LED lighter through the switch; and the solar panel is disposed on the body and electrically connected to the battery through the control unit, the solar panel transforms absorbed light into electric power, which is stored in the battery through the charging circuit of the control unit.

Wherein the battery is a lithium battery.

Wherein the electronic device is a mobile phone.

Wherein the external charging connector is a female USB connector and the electronic device as the mobile phone has a male USB connector as a mini USB, the electronic device is electronically connected to the power supply device through the male USB connector and the female USB connector.

Wherein the body has a wearing portion and a brim, the wearing portion has an accommodation bag, the power supply device 20 disposed in the accommodation bag, the lighting device is disposed on the front edge of the brim, the solar panel is disposed on the brim.

Wherein the body is a safety helmet.

Wherein the external charging connector is electrically connected to a transformer, which is electrically connected to a plug, the battery is charged by way of power through the plug to the power supply device.

Wherein the external charging connector is electrically connected to a USB slot of a computer, the battery is charged by way of power from the computer to the power supply device.

Wherein the electronic device is an mp3 player.

Wherein the LED lighter further comprises a protuberance along bottom of a front end The improvements of the present invention according to above descriptions are then as follows:

1. The present invention absorbs light via the solar panel on the body so as to charge the battery of the power supply device, which continuously provides power while the present invention is being applied in an outdoors.

2. The lighting device on the brim can be controlled by the switch, so that the present invention has the functions of lighting and safety reminder. Moreover, an individual may adjust illumination angle of the LED lighter as desired so as to be more adaptable.

3. In addition to the solar panel, the power supply device is able to charge the battery via the transformer electrically connected to the plug. Further, the computer provides power to the power supply device via the USB slot in order to charge the battery. Hence, the charging way of the power supply device is more diversiform, so that the convenience is improved.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
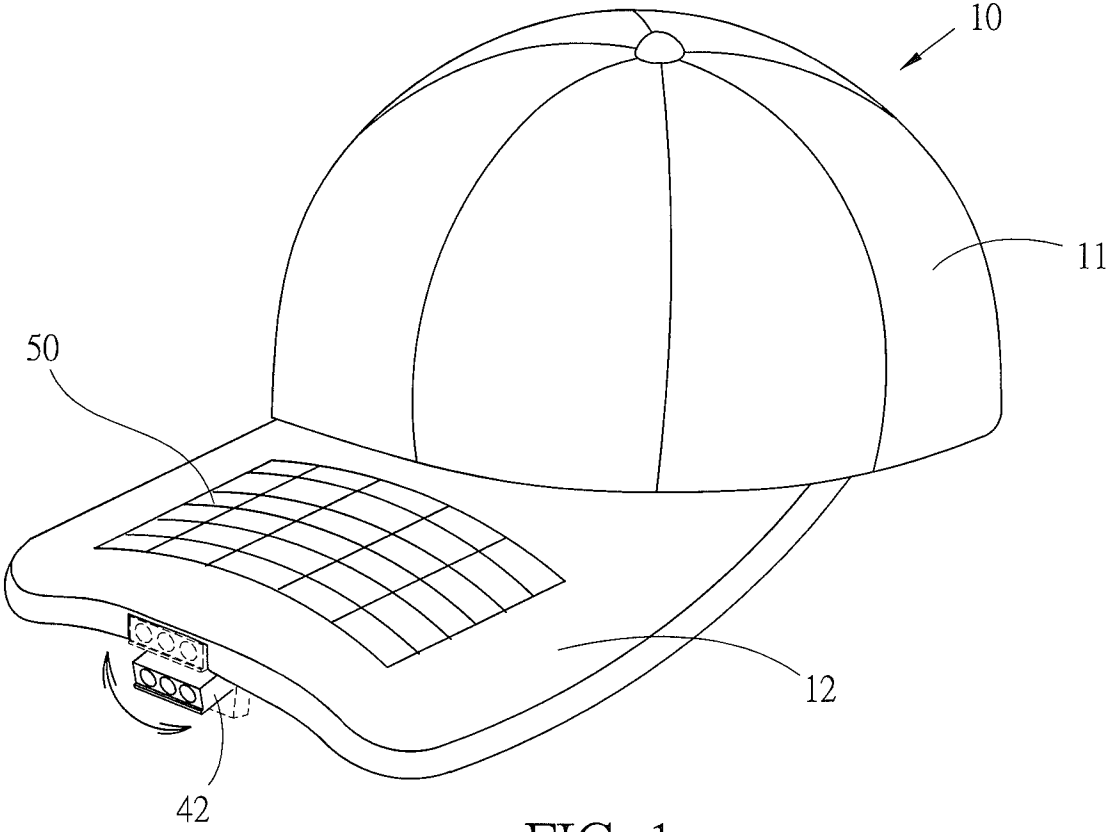
FIG. 1 illustrates a schematic 3-D view of a preferred embodiment of the present invention.
Figure 2:
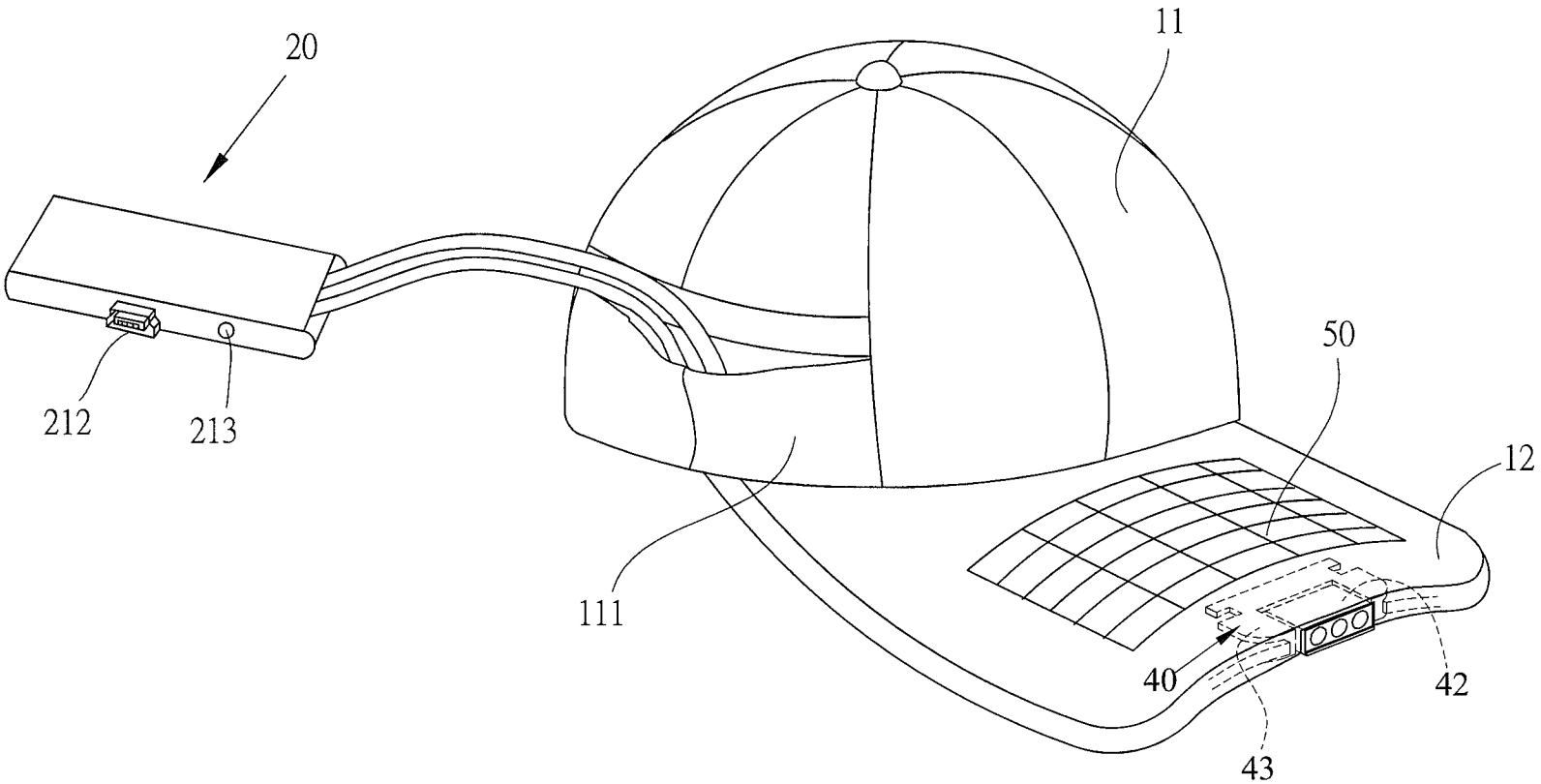
FIG. 2 is a view similar to FIG. 1 showing a power supply device being taken out of the hat.
Figure 3:
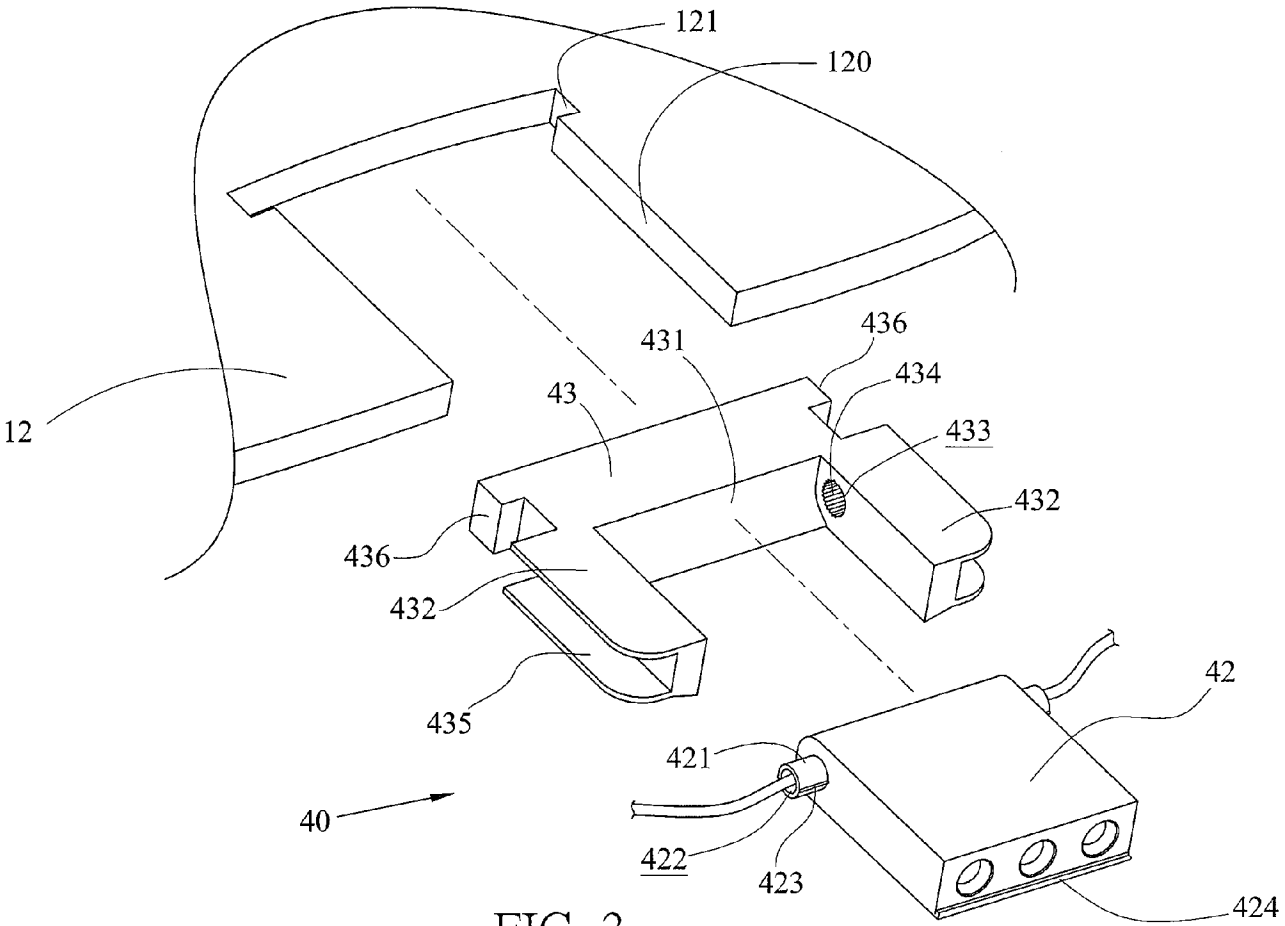
FIG. 3 illustrates a schematic exploded view of lighting device of the preferred embodiment of the present invention.
Figure 4:
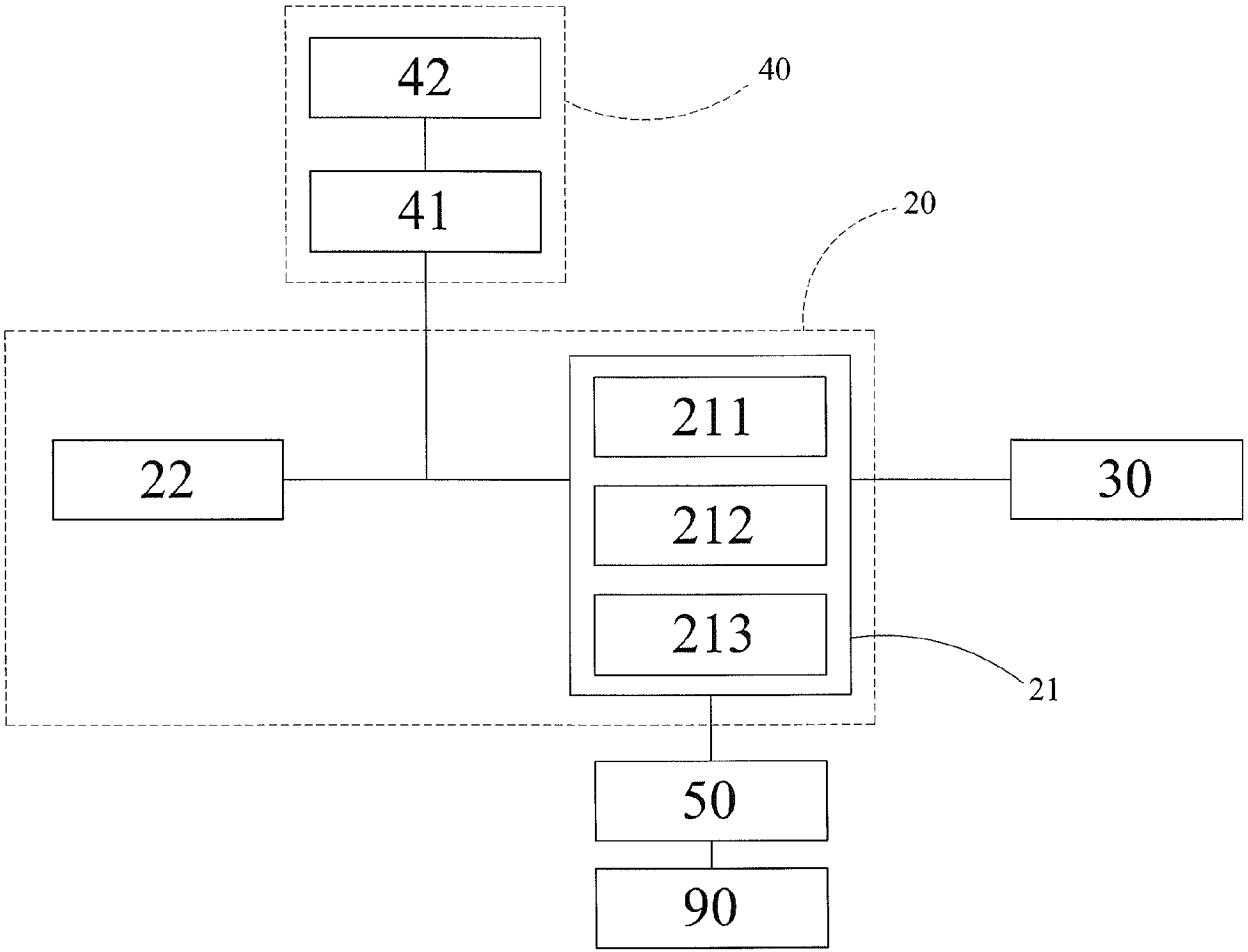
FIG. 4 illustrates a schematic block diagram of the preferred embodiment of the present invention.

Following preferred embodiments and figures will be described in detail so as to approach aforesaid object.

With reference to FIG. 1 to FIG. 10, the present invention provides a hat with a solar system and includes: a body 10, a power supply device 20, a lighting device 40, and a solar panel 50, wherein the power supply device 20 is disposed on the body 10 and has a control unit 21 and a battery 22, the control unit 21 has a charging circuit 211 and at least one external charging connector 212, which is electrically connected to an electronic device 30 as mobile phone 31, MP3 player 32, etc., the battery 22 is able to charge the electronic device; the lighting device 40 includes a switch 41 and at least one LED lighter 42, the lighting device 40 is electrically connected to the battery 22 of the power supply device 20 and turns on or shuts down the LED lighter 42 through the switch 41; the solar panel 50 is disposed on the body 10 and electrically connected to the battery 22 through the control unit 21, the solar panel 50 transforms absorbed light into electric power, which is stored in the battery 22 through the charging circuit 211 of the control unit 21.

Wherein the control unit 21 further includes an LED charging lighter 213. While the power supply device 20 is being charged through the solar panel 50 or an external power source, the LED charging lighter 213 is green; on the other hand, the LED charging lighter 213 is red while the power supply device 20 is charging the electronic device 30, so that a user easily identifies the usage.

Figure 5:
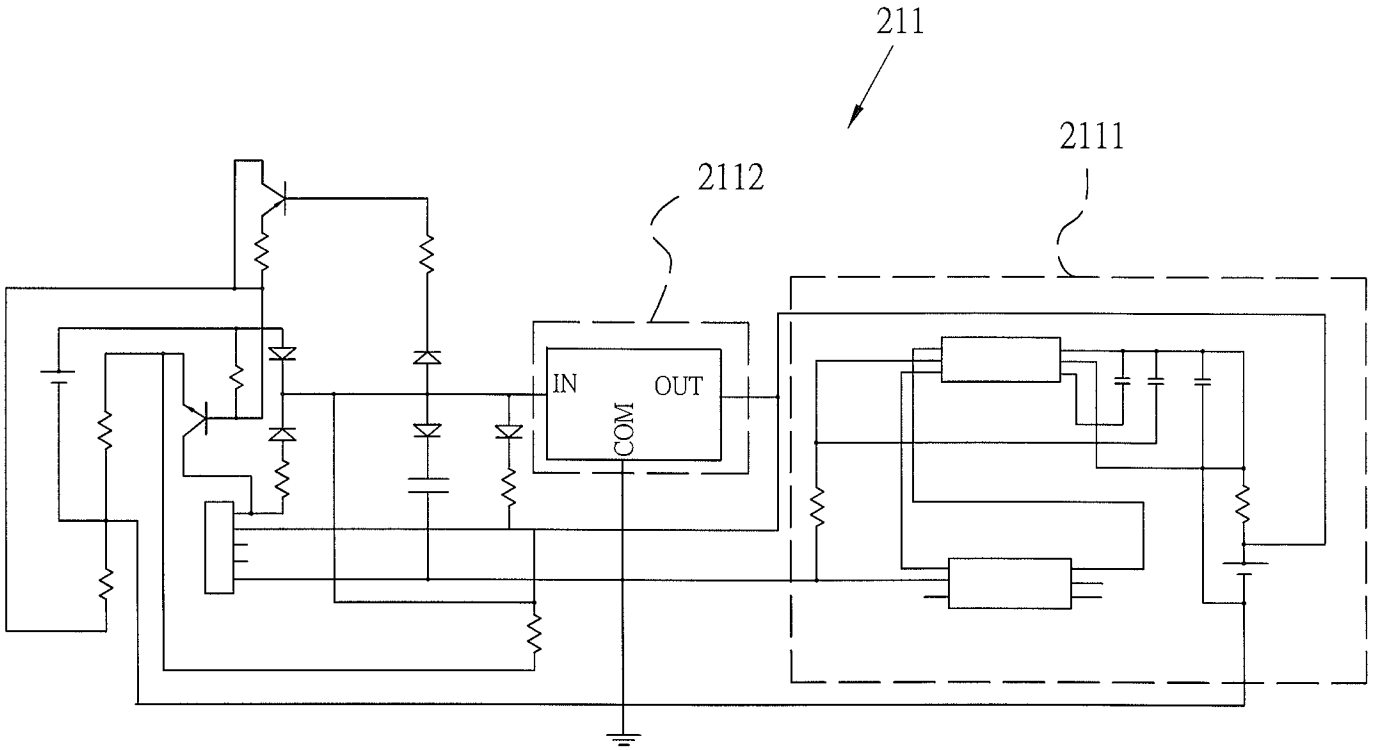
FIG. 5 illustrates a schematic view of a charging circuit of the preferred embodiment of the present invention.

With reference to FIG. 5, the charging circuit 211 includes a battery-protection circuit 2111 and a voltage-regulation circuit 2112.

Wherein the battery 22 is a lithium battery.

Wherein the external charging connector 212 is a female USB connector and the electronic device as the mobile phone has a male USB connector as a mini USB, the electronic device is electronically connected to the power supply device 20 through the male USB connector and the female USB connector.

Wherein the body 10 has a wearing portion 11 and a brim 12 including a rectangular recess 120 on the front edge, and an elongated cavity 121 on a rear end of the recess 120, the cavity 121 having a width greater than that of the recess 120. The wearing portion 11 has an accommodation bag 111, the power supply device 20 is disposed in the accommodation bag 111, the lighting device 40 is disposed on the front edge of the brim 12, and the solar panel 50 is disposed on the brim 12.

The lighting device 40 comprises a U-shaped seat 43 and an LED lighter 42. The seat 43 is releasably fitted in the cavity 121 by clamping. The seat 43 includes a recessed portion 431 open to the front end, two wings 432 on both sides respectively, two holes 433 through the wings 432 respectively, two round gears 434 each formed around a circular inner surface of the hole 433, two bifurcated guide grooves 435 each formed on an outer surface of the wing 432, and two projections 436 at both ends of a rear portion respectively, the projection 436 being aligned with the corresponding guide groove 435. The guide grooves 435 can slide along both sides of the recess 120 to fit the projections 436 in both ends of the cavity 121 respectively. As a result, the seat 43 is held in place in the recess 120 and the cavity 121.

Figure 8:
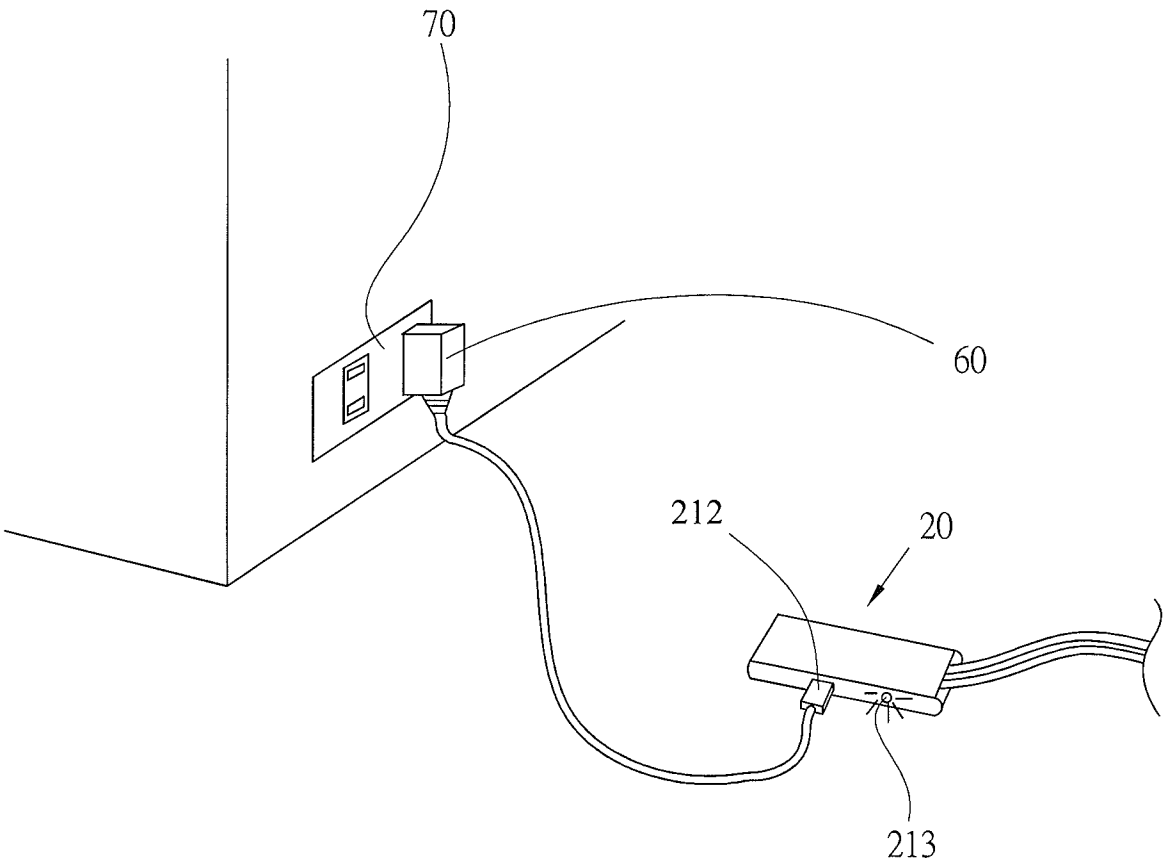
FIG. 8 illustrates a schematic view of a third usage of the preferred embodiment of the present invention.
Figure 9:
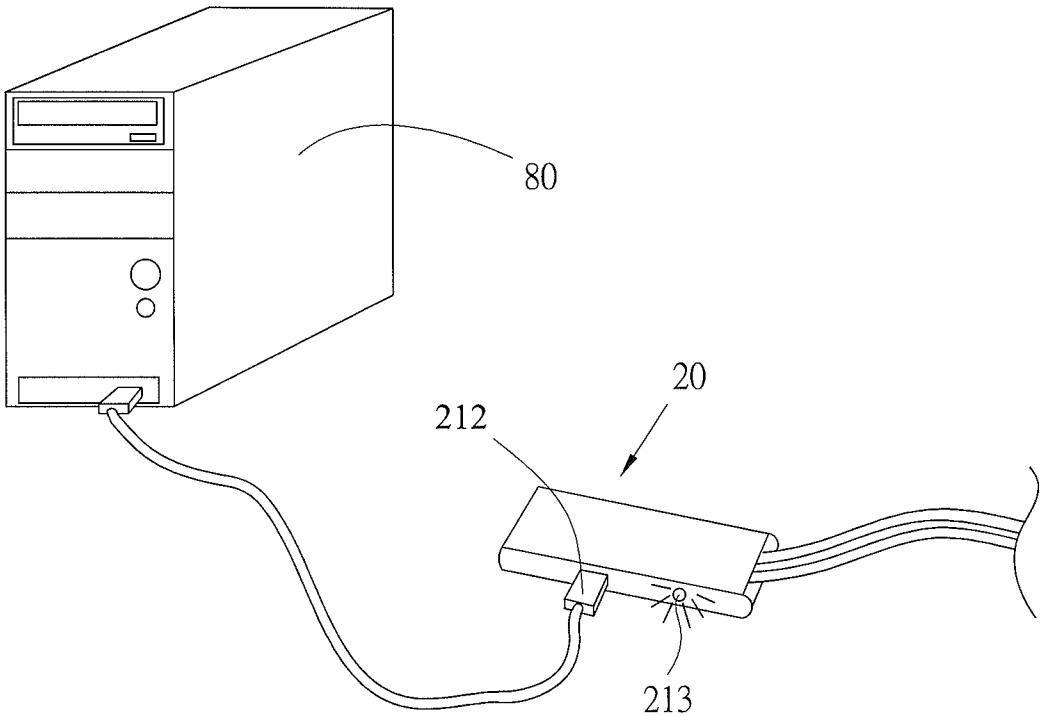
FIG. 9 illustrates a schematic view of a fourth usage of the preferred embodiment of the present invention.

The LED lighter 42 is shaped as a parallelepiped and adapted to fit in the recessed portion 431. The LED lighter includes two hollow cylinders 421 on both sides of a rear portion respectively, each cylinder 421 having a bore 422 for allowing wire of the LED lighter 42 to pass, and a lengthwise protrusion 423 on an outer surface. The protrusion 423 engages the tooth of the corresponding gear 434. Thus, for illuminating a target object an individual may pivot the LED lighter 42 about the holes 433 (i.e., the seat 43) by clockwise or counterclockwise rotating the LED lighter 42 a desired angle in a tooth-by-tooth step. It is noted that an angle of the LED lighter 42 with respect to the seat 43 can be maintained after the pivoting due to the gear engagement of the protrusions 423 and the teeth of the gears 434.

Wherein the body 10 is a safety helmet.

Wherein the LED lighter 42 further comprises a protuberance 424 along bottom of its front end. The protuberance 424 is a slip resistant member so as to facilitate above angle adjustment of the LED lighter 42 by the hand.

Wherein the external charging connector 212 can be charged by a regular charger and is electrically connected to a transformer 60, which is between AC-110V to DC-5V and electrically connected to a plug 70, the battery 22 is charged by way of power through the plug 70 to the power supply device 20, as shown in FIG. 8.

Wherein the external charging connector 212 is electrically connected to a USB slot of a computer 80, the battery 22 is charged by way of power from the computer 80 to the power supply device 20, as shown in FIG. 9.

Figure 7:
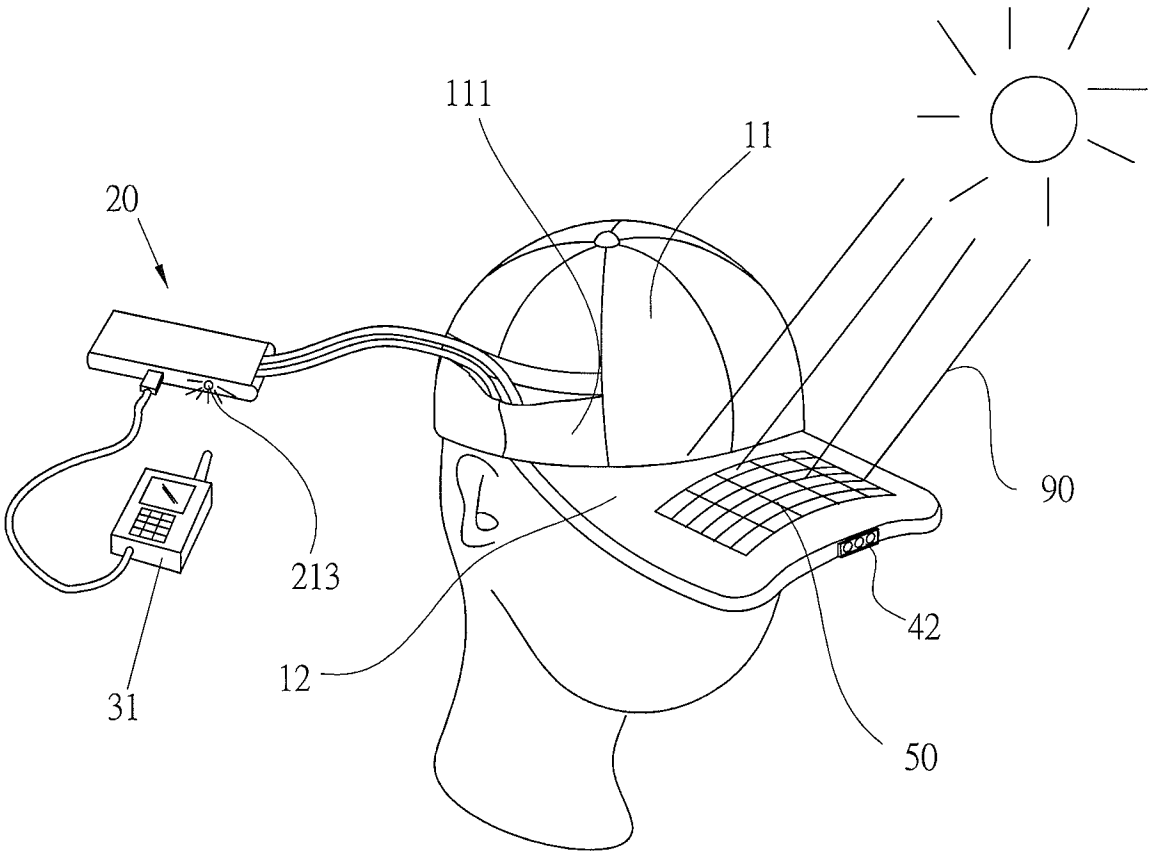
FIG. 7 illustrates a schematic view of a second usage of the preferred embodiment of the present invention.
Figure 10:
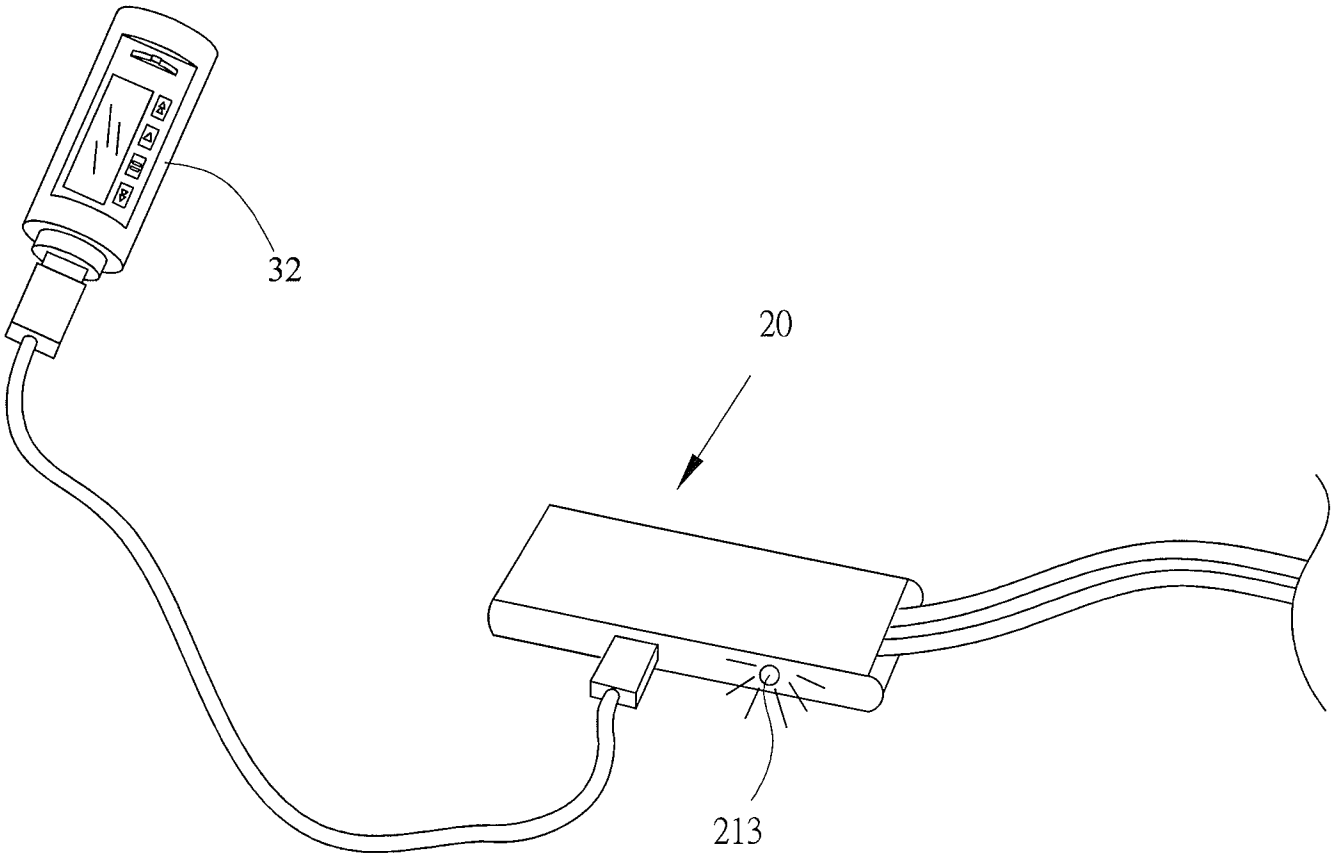
FIG. 10 illustrates a schematic view of a fifth usage of the preferred embodiment of the present invention.
Figure 11:
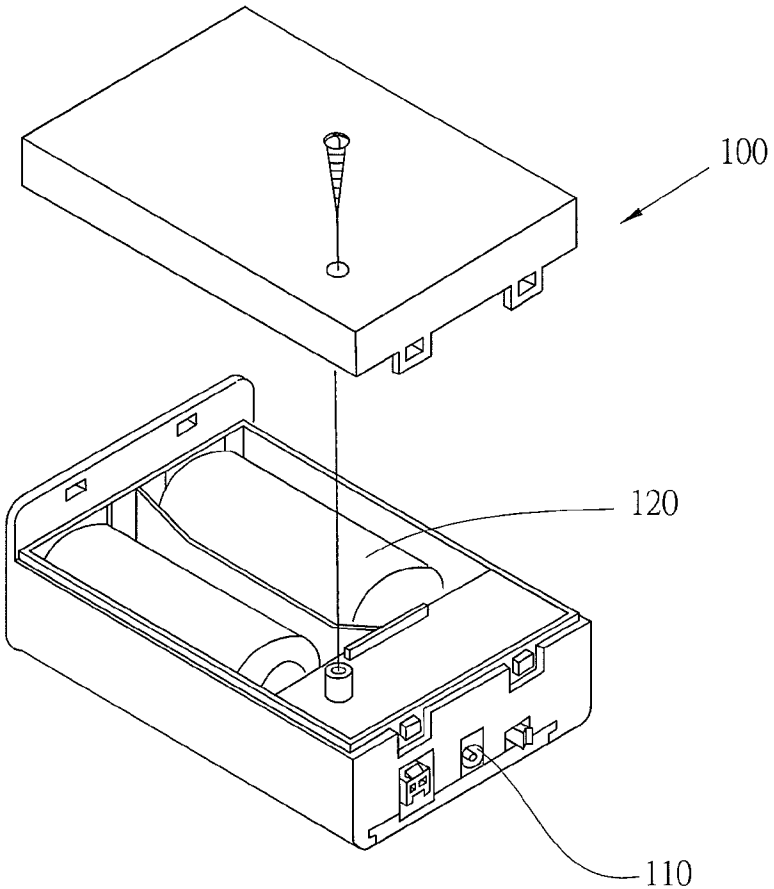
FIG. 11 PRIOR ART
FIG. 11 illustrates a schematic partial exploded view of a battery box of a prior art.

With reference to FIG. 7 and FIG. 10, while the present invention is applied in an outdoors with light 90, the electronic device 30 such as mobile phone 31 or MP3 player 32, which is necessary to be charged, can be continuously charged by the present invention. So that the present invention meets the requirement of environment protection and convenience.

Figure 6:
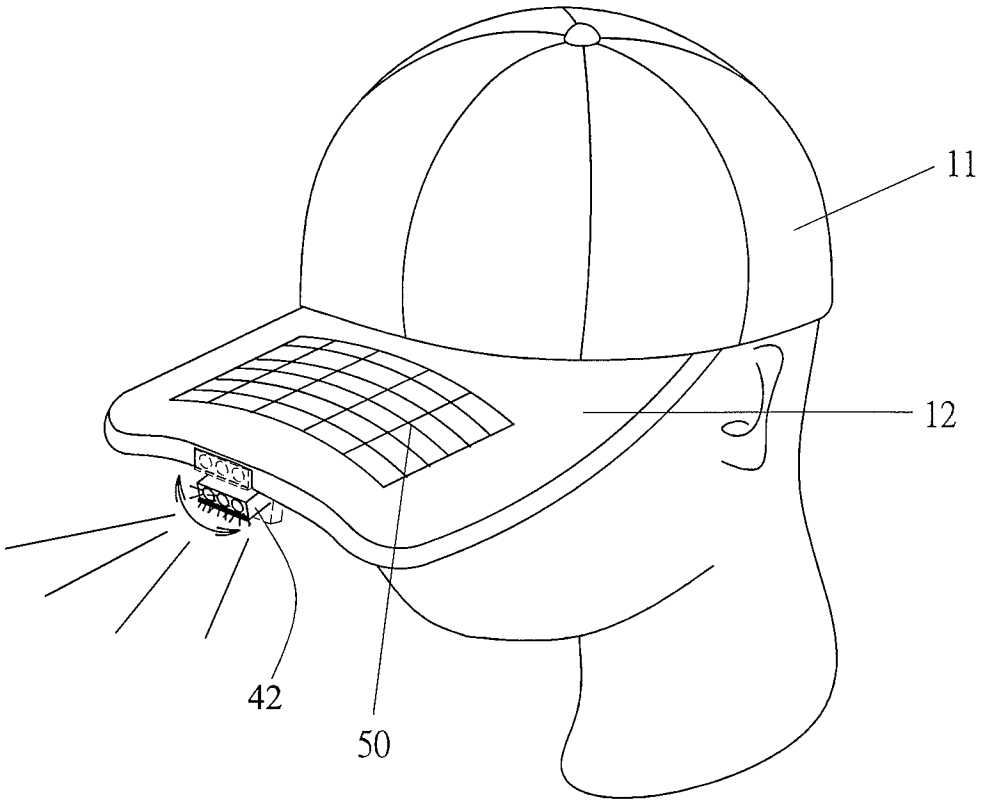
FIG. 6 illustrates a schematic view of a first usage of the preferred embodiment of the present invention.

With reference to FIG. 6, the lighting device 40 of the body 10 provides the functions of lighting and safety reminder while the present invention is being applied in a dark site.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A hat with a solar system comprising:

a body having an accommodation bag wherein the body has a wearing portion and a brim, the brim including a rectangular recess on a front edge, and an elongated cavity on a rear end of the recess;

a power supply device disposed in the accommodation bag of the body and having a control unit and a battery, the control unit having a charging circuit and at least one external charging connector that is electrically connected to an electronic device, the battery being able to charge the electronic device;

a lighting device comprising a switch, a seat, and an LED lighter, the lighting device being electrically connected to the battery of the power supply device and turning on or shutting down the LED lighter through the switch; wherein the seat includes a recessed portion open to a front end, two wings on both sides respectively, two holes through the wings respectively, two round gears each formed around a circular inner surface of the hole, two bifurcated guide grooves each formed on an outer surface of the wing, and two projections at both ends of a rear portion respectively, the projection being aligned with the corresponding guide groove; and wherein the LED lighter is shaped to releasably fit in the recessed portion, and the LED lighter includes two hollow cylinders on both sides of a rear portion respectively, each hollow cylinder having a lengthwise protrusion on an outer surface, the protrusion engaging the tooth of the corresponding gear so as to allow the LED lighter to clockwise or counterclockwise pivot about the seat in a tooth-by-tooth step; and a solar panel disposed on the body and electrically connected to the battery through the control unit, the solar panel transforming absorbed light into electric power, which is stored in the battery through the charging circuit of the control unit.

2. The hat with a solar system according to claim 1, wherein the control unit further comprises an LED charging lighter.

3. The hat with a solar system according to claim 1, wherein the charging circuit comprises a battery-protection circuit and a voltage-regulation circuit.

4. The hat with a solar system according to claim 1, wherein the battery is a lithium battery.

5. The hat with a solar system according to claim 1, wherein the electronic device is a mobile phone.

6. The hat with a solar system according to claim 1, wherein the external charging connector is a female USB connector and the electronic device has a male USB connector, the electronic device being electronically connected to the power supply device through the male USB connector and the female USB connector.

7. The hat with a solar system according to claim 1, wherein the body has a wearing portion and a brim, the accommodation bag being disposed on the wearing portion, the lighting device being disposed on the front edge of the brim, the solar panel being disposed on the brim.

8. The hat with a solar system according to claim 1, wherein the body is a safety helmet.

9. The hat with a solar system according to claim 1, wherein the external charging connector is electrically connected to a transformer, which is electrically connected to a plug, the battery being charged by way of power through the plug to the power supply device.

10. The hat with a solar system according to claim 1, wherein the external charging connector is electrically connected to a USB slot of a computer, the battery being charged by way of power from the computer to the power supply device.

11. The hat with a solar system according to claim 1, wherein the electronic device is an mp3 player.

12. The hat with a solar system according to claim 1, wherein the LED lighter further comprises a protuberance along bottom of a front end.

* * * * *